United States Patent [19]

Gupta et al.

[11] Patent Number: 4,680,060

[45] Date of Patent: Jul. 14, 1987

[54] PROCESS FOR THE EXTRACTION OF CONTAMINANTS FROM PLASTICS

[75] Inventors: Ashis S. Gupta, Marietta; Jerald T. Camp, Loganville, both of Ga.

[73] Assignee: The Coca-Cola Company, Atlanta, Ga.

[21] Appl. No.: 778,005

[22] Filed: Sep. 20, 1985

[51] Int. Cl.[4] ..... B08B 30/00

[52] U.S. Cl. ..... 134/26; 134/25.4; 134/30; 134/22.1; 134/22.11; 134/22.14; 134/40; 252/160; 252/170

[58] Field of Search ..... 134/25.1, 25.4, 26, 134/30, 22.1, 22.11, 22.14, 40; 252/160, 170

[56] References Cited

U.S. PATENT DOCUMENTS

| | | | |
|---|---|---|---|
| 3,969,134 | 7/1976 | Batka et al. | 252/174.21 |
| 4,157,921 | 6/1979 | Baturay et al. | 252/159 |
| 4,172,044 | 10/1979 | Zeidler et al. | 252/173 |
| 4,434,069 | 2/1984 | Fairchild | 234/25.1 |
| 4,592,787 | 6/1986 | Johnson | 252/173 |

FOREIGN PATENT DOCUMENTS 528876 11/1939 United Kingdom ..... 134/22.14

OTHER PUBLICATIONS

Chemical Abstract, 104:226756d (1986).
Chemical Abstract 103:106659e (1985).
Chemical Abstract 93:152048e (1978).
Chemical Abstract 89:165337r (1976).

*Primary Examiner*—Andrew H. Metz
*Assistant Examiner*—A. Pal
*Attorney, Agent, or Firm*—Birch, Stewart, Kolasch & Birch

[57] ABSTRACT

A process for the extraction of contaminants from plastics is disclosed. A plastic surface is contacted with an alcohol to extract any contaminants which have been absorbed by or adsorbed on the plastic surface. Thereafter, the plastic surface is rinsed with water to remove any remaining alcohol. The process has particular applicability in cleaning plastic bottles and plastic post-mix beverage dispensing lines.

15 Claims, No Drawings

PROCESS FOR THE EXTRACTION OF CONTAMINANTS FROM PLASTICS

BACKGROUND OF THE INVENTION

1. Field of the Invention

The present invention is directed to a process for the extraction of contaminants from plastics, e.g. plastic bottles and plastic beverage dispensing lines. More specifically, the present invention is directed to extracting contaminants from plastics by the application of an alcohol to a plastic surface.

2. Description of the Prior Art

One problem encountered in the use of post-mix beverage dispensing systems is that impurities remain in the plastic lines when a line is converted from dispensing a pungent flavored liquid such as root beer to a delicate flavored beverage such as Sprite® (a registered trademark of The Coca-Cola Company). Specifically, root beer contains methyl salicylate which is absorbed by and adsorbed on the plastic tubing. When a root beer line is converted to dispense Sprite®, the residual methyl salicylate causes the Sprite® to develop an objectionable taste. Preliminary evaluation results indicate that root beer contamination in Sprite® at a level of 15 ppm methyl salicylate is detectable though not objectionable. Beyond a methyl salicylate concentration of 20 ppm, the Sprite® is not acceptable. If the methyl salicylate concentration is 10 ppm or below, the Sprite® product is acceptable and has virtually no detectable root beer flavor.

Another major problem encountered in the beverage industry is the present inability to recycle and refill containers such as PET plastic two liter bottles. There is a strong need to remove chemical contaminants, dirt and soil, and microbiological contaminants so that the beverage contained in the plastic bottle will have below the allowable daily intake levels (ADI) of contaminants and thus the plastic bottle could be recycled. Once this recycling is achieved, production costs will be reduced considerably.

SUMMARY OF THE INVENTION

Accordingly, an object of the present invention is to provide a process for extracting any contaminants absorbed by or adsorbed on a plastic surface.

It is a further object of the present invention to remove any chemical, microbiological or soil contaminants from plastic bottles so that any liquid to be consumed by humans from these bottles will have below the allowable daily intake levels of such contaminants.

It is still another object of the present invention to clean and reuse plastic bottles for refilling.

It is yet another object of the present invention to extract methyl salicylate and other contaminants from post-mix syrup beverage plastic dispensing lines before the line is converted to another beverage.

These and other objects of the present invention are fulfilled by contacting the surface of a plastic bottle, tube, or any similar device with an alcohol to extract any contaminants which have been absorbed by and adsorbed on the plastic surface, and thereafter rinsing the surface to remove any remaining alcohol. In the case of a post-mix beverage dispensing line, the alcohol is flushed through the line until the contaminants have been extracted to an acceptable level. On the other hand, a plastic bottle is immersed in the alcohol until the contaminants have been extracted.

It is preferable to have washed the plastic surface with a detergent solution before the alcohol treatment, although this step is not necessary. This step would clean the surface but would not extract any absorbed contaminants.

The alcohol treatment is effective for any plastic surface. Polypropylene, acrylonitrile and polyethylene terephthalate are particularly effected by this process.

Propylene glycol is the preferred alcohol used in the present process, although other alcohols such as ethanol can be used effectively. If cleaning with a detergent solution before extraction with alcohol is conducted, LIQUALIN® (a registered trademark of Oakite Products) or Versa-clean® (a registered trademark of Fisher Scientific) detergent solution is typically employed, but any commercially available detergent solution may be used. Preferably, the detergent solution is non-caustic.

The plastic surface is preferably contacted with alcohol at a temperature of about 140 degrees to 160 degrees Farenheit for a period of about 2 to 4 hours. If the surface is first washed with detergent solution, the detergent is usually at a temperature of about 140 degrees to 170 degrees Farenheit and the contact time is about 20 to 40 minutes. An optional water rinse can be conducted between the detergent and alcohol steps. The flowrate of the alcohol and/or detergent is generally about 20 GPM.

Further scope and applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

EXAMPLE I

Regular 2-liter PET bottles were contaminated with two pesticides, Malathion and Lindane, by filling the bottles with one of these pesticides and storing them at 110 degrees Farenheit for 30 days. Malathion is a tradename for a mixture of chemicals comprising [(Dimethoxyphosphinothioyl)thio]butanedioic acid diethyl ester, mercaptosuccinic acid diethyl ester; S-ester with O,O-dimethyl phosphorothioate and other additives. Lindane is a tradename for a mixture of chemicals comprising 1α,2α,3α,4α,5α,6α-Hexachlorocyclohexane, gamma benzene hexachloride, and other additives. The bottles were emptied and rinsed with hot wter at 140 degrees Farenheit. These bottles were then immersed in propylene glycol at 140 degrees Farenheit for 60 minutes. Thereafter, these bottles were filled with Coke® (a registered trademark of The Coca-Cola Company) and stored at room temperature for 30 days. For comparison, a new PET bottle was filled with Coke® and stored with the other bottles to be used as a standard. After 30 days the contents of the bottles were poured out and there was no smell of the solvent in the pesticide. This indicates that there was essentially no pesticide remaining.

EXAMPLE II

Regular 2-liter acrylonitrile (AN) bottles were contaminated with two pesticides, Malathion and Lindane, by filling the bottles with one of these pesticides and storing them at 110 degrees Farenheit for 30 days. Thereafter, the bottles were rinsed with hot water and cleansed by immersing in 140 degrees Farenheit propylene glycol for 60 minutes. The bottles were rinsed with cold water and filled with model beverage and stored again at 110 degrees Farenheit for 30 days. The model beverage was analyzed for pesticide residue and the results indicate that the residual Malathion level in the model beverage was 0.0165 ppm or about 4.7% of ADI. Similarly, the Lindane level in the model beverage was 0.0035 ppm or about 2% of ADI.

EXAMPLE III

A polypropylene root beer dispensing line of a post-mix beverage dispensing system was rinsed with hot water having a temperature of about 170 degrees Farenheit. Thereafter, the line was washed with a 2% solution of LIQUALIN. The line was then rinsed with hot water having a temperature of about 170 degrees Farenheit. Hot propylene glycol having a temperature of about 170 degrees Farenheit was flushed through the line and thereafter the line was rinsed with hot water. Finally, the line was filled with and operated to dispense Sprite® (a registered trademark of The Coca-Cola Company) syrup. Samples of the Sprite® did not have an objectionable taste or smell.

The invention being thus described, it will be obvious that the same way be varied in many ways. Such variations are not to be regarded as a departure from the spirit and scope of the invention, and all such modifications as would be obvious to one skilled in the art are intended to be included within the scope of the following claims.

What is claimed is:

1. A process for the removal of contaminants from plastic tubing used in syrup lines of a post-mix beverage dispenser, which comprises the steps of:

flushing said tubing with propylene glycol to extract the contaminants; and rinsing said tubing with water to remove any remaining propylene glycol.

2. The procss as recited in claim 1, which is preceded by flushing the plastic tubing with a detergent solution and thereafter rinsing with water.

3. The process as recited n claim 2, wherein the plastic tubing is flushed with the detergent solution for about 20 to 40 minutes.

4. The process as recited in claim 2, wherein the detergent solution is at a temperature of about 140 degrees Farenheit to 170 degrees Farenheit.

5. The process as recited in claim 2, wherein the detergent has a flow rate of at least 20 GPM.

6. The process as recited in claim 2, wherein the propylene glycol has a flowrate of at least 20 GPM.

7. The process as recited in claim 1, wherein the plastic tubing is polypropylene tubing.

8. The process as recited in claim 1, wherein the propylene glycol is at a temperature of about 140 degrees Farenheit to 160 degrees Farenheit.

9. The process as recited in claim 1, wherein the plastic tubing is flushed with the polypropylene glycol for about 2 to 4 hours.

10. A process for removing contaminants from a plastic bottle, which comprises the steps of:

immersing the bottle in propylene glycol; draining out propylene glycol from the bottle; and rinsing the bottle with water inside and out.

11. The process as recited in claim 10, which is preceded by cleaning the inside of the plastic bottle with detergent solution and thereafter rinsing with water.

12. The process as recited in claim 10, wherein the plastic bottle is composed of a material selected from the group consisting of polyethyleneterephthalate and acrylonitrile.

13. The process as recited in claim 11, wherein the detergent solution is at a temperature of about 130 to 150 degrees Farenheit.

14. The process as recited in claim 10, wherein the polypropylene glycol is at a temperature of about 130 to 150 degrees Farenheit.

15. The process as recited in claim 10, wherein the plastic bottle is immersed in polypropylene glycol for about 5 to 9 minutes.

* * * * *